US006905241B2

(12) United States Patent
Zazovsky et al.

(10) Patent No.: US 6,905,241 B2
(45) Date of Patent: Jun. 14, 2005

(54) DETERMINATION OF VIRGIN FORMATION TEMPERATURE

(75) Inventors: Alexander Zazovsky, Houston, TX (US); Sammy S. Haddad, Mandeville, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 77 days.

(21) Appl. No.: 10/249,068

(22) Filed: Mar. 13, 2003

(65) Prior Publication Data

US 2004/0190589 A1 Sep. 30, 2004

(51) Int. Cl.[7] ..... G01K 1/16; G01K 3/04; E21B 47/00; G01V 9/00

(52) U.S. Cl. ..... 374/134; 374/25; 374/102; 73/152.01; 702/11; 324/324; 324/332

(58) Field of Search ..... 374/134–137, 374/25, 102; 73/152.25, 155, 152.07, 152.02, 152.03, 152.12, 152.13, 152.33; 703/2; 702/6–7, 9, 11; 324/332, 333, 324

(56) References Cited

U.S. PATENT DOCUMENTS

| | | | | | |
|---|---|---|---|---|---|
| 2,274,248 | A | * | 2/1942 | Scherbatskoy et al. | 73/152.13 |
| 2,316,942 | A | * | 4/1943 | Doll | 374/136 |
| 3,083,567 | A | * | 4/1963 | Cronberger et al. | 73/152.13 |
| 3,122,016 | A | * | 2/1964 | Fordham | 374/136 |
| 3,186,222 | A | * | 6/1965 | Martin | 340/853.7 |
| 3,327,527 | A | * | 6/1967 | Arps | 73/152.03 |
| 3,494,186 | A | * | 2/1970 | Lowrie et al. | 73/152.12 |
| 3,807,227 | A | * | 4/1974 | Smith, Jr. | 73/152.13 |
| 3,864,969 | A | * | 2/1975 | Smith, Jr. | 73/152.13 |
| 3,880,234 | A | * | 4/1975 | Showalter et al. | 73/152.12 |
| 3,913,398 | A | * | 10/1975 | Curtis | 73/152.33 |
| 3,934,468 | A | | 1/1976 | Brieger | |
| 4,313,342 | A | * | 2/1982 | Poppendiek | 374/29 |
| 4,314,339 | A | | 2/1982 | Kenyon | |
| 4,375,164 | A | * | 3/1983 | Dodge et al. | 73/152.12 |
| 4,427,941 | A | * | 1/1984 | Riedesel et al. | 324/323 |
| 4,575,261 | A | | 3/1986 | Berger et al. | |
| 4,616,705 | A | * | 10/1986 | Stegemeier et al. | 166/250.01 |
| 4,860,581 | A | | 8/1989 | Zimmerman et al. | |

(Continued)

FOREIGN PATENT DOCUMENTS

| | | |
|---|---|---|
| EP | 05653223 A | 10/1993 |
| EP | 1003053 A2 | 5/2000 |
| GB | 2382601 A | 6/2003 |
| WO | WO 02/057595 | 7/2002 |

OTHER PUBLICATIONS

Sashikar et al., Determination of Formation Temperature from Flow Tests: A New Solution, SPE 21707, Apr. 7–9, 1991, pp. 701–713.

Raymond, L.R., Temperature Distribution in a Circulating Drilling Fluid, SPE 2320, Mar., 1969, pp. 333–341.

*Primary Examiner*—Gail Verbitsky
(74) *Attorney, Agent, or Firm*—J.L. Jennie Salazar; Brigitte L. Echols

(57) ABSTRACT

A method for determining virgin formation temperature of earth formations surrounding a borehole is provided. The time duration of drilling fluid circulation and the time after cessation of drilling fluid circulation at the borehole depth regions of interest are tracked. At a particular borehole depth region of interest, fluid flows from the formations into a device in the borehole, and the temperature of the fluid as a function of time with respect to initiation of fluid flow is measured. The thermal history of formations surrounding the particular borehole depth region is modeled for a cooling phase during drilling fluid circulation, a temperature build-up phase after cessation of drilling fluid circulation, and a formation fluid flow phase after initiation of fluid flow. The model and temperature measurements are used to determine a trend of temperature evolution and the virgin formation temperature by extrapolation from the trend.

20 Claims, 5 Drawing Sheets

U.S. PATENT DOCUMENTS 5,159,569 A * 10/1992 Xu et al. ..... 702/13
5,174,377 A 12/1992 Kumar
5,321,612 A 6/1994 Stewart
5,415,037 A * 5/1995 Griston et al. ..... 73/152.12
5,812,068 A * 9/1998 Wisler et al. ..... 340/855.5
6,351,991 B1 * 3/2002 Sinha ..... 73/152.01
6,789,937 B2 * 9/2004 Haddad et al. ..... 374/136
2002/0010548 A1 1/2002 Tare et al.
2003/0010494 A1 * 1/2003 Bose et al. ..... 166/254.2
2003/0034777 A1 * 2/2003 Chen et al. ..... 324/303
2003/0236626 A1 * 12/2003 Schroeder et al. ..... 702/6
2004/0007058 A1 1/2004 Rylander et al.
2004/0059512 A1 * 3/2004 Thomann et al. ..... 702/6
2004/0064257 A1 * 4/2004 Tobias et al. ..... 702/6
2004/0068375 A1 * 4/2004 Cook et al. ..... 702/11
2004/0073371 A1 * 4/2004 Haugland ..... 702/7
2004/0117118 A1 * 6/2004 Collins et al. ..... 702/6
2004/0129070 A1 * 7/2004 Bolze et al. ..... 73/152.02

* cited by examiner

FIG.6
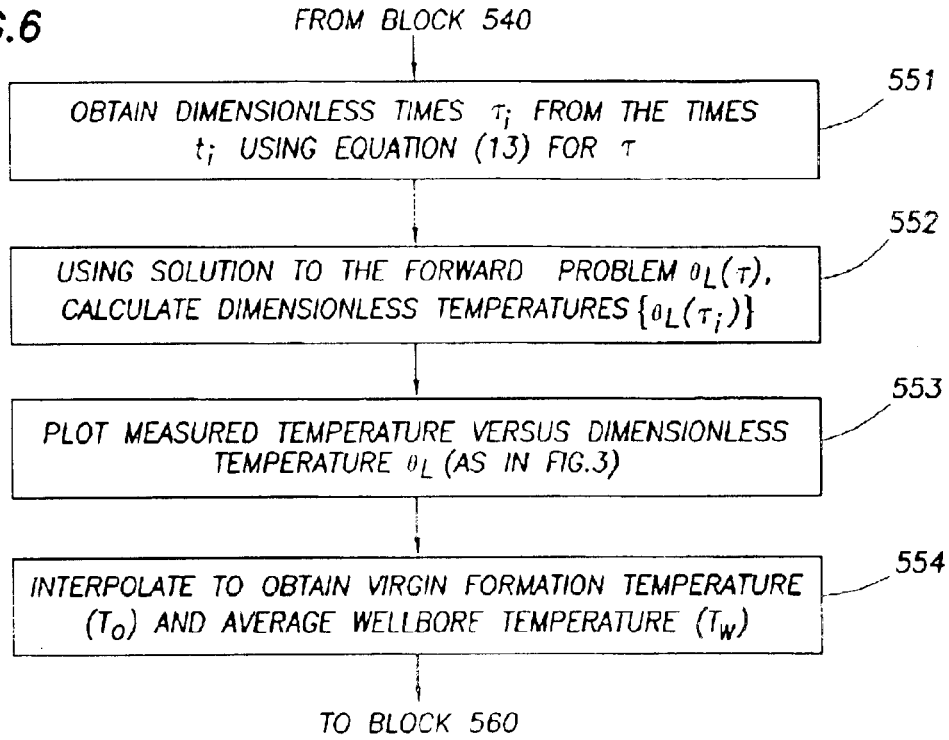
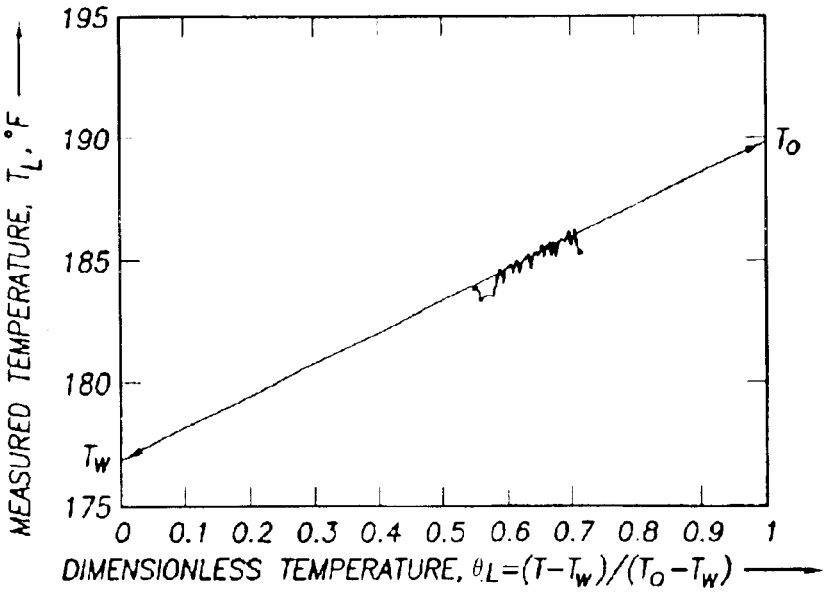
FIG.7

DETERMINATION OF VIRGIN FORMATION TEMPERATURE

BACKGROUND OF INVENTION

This invention relates to the field of earth formation testing and, more particularly to a method for determining the virgin temperature of formations surrounding an earth borehole.

The undisturbed (or virgin) formation temperature at depth regions of interest is usually estimated from open hole and cased hole logging tools measurements, and from slick line temperature and pressure gauges. These are actually wellbore fluid measurements. The stabilized temperature from sampling/pump-out measurements from formation testing tools has also been used to obtain formation temperature.

There is a need for a rigorous technique to obtain actual formation temperature using, for example, measurements from a formation testing tool. Production data has shown that actual fluid temperatures arriving at production facilities are significantly higher than those calculated based on early formation pressure estimations. Accurate temperature prediction has great impact on the effectiveness of the following: flow assurance designs including paraffin and asphaltene deposition, and hydrate formation; production casing and tubing design, including expensive tubing insulation design; and production facility design. In high cost fields, such as deepwater and ultra-deep wells, temperature impacts wellbore construction, and sub-sea and surface production facilities that can be extremely expensive.

Some representative prior art approaches for temperature determination will next be listed. The approach of S. V. Kashikar and F. C. Arnold, "Determination of Formation Temperature From Flow Tests: A New Solution", SPE 21707, Production Operations Symposium, Oklahoma City, Okla., Apr. 7–9, 1991, includes determination of formation temperature from flow tests. The approach of L. R. Raymond, "Temperature Distribution in a Circulating Drilling Fluid", SPE 2320, JPT, March, 1969, includes determination of temperature distribution in a circulating drilling fluid. The approach of M. N. Hashem (2002): "Measuring The In Situ Static Formation Temperature", Published PCT International Patent Application WO 02/057595 A1, 25 Jul. 2002, includes measuring the temperature of fluid produced by a wireline tool when the formation fluid is substantially uncontaminated. Reference can also be made to U.S. Pat. Nos. 4,575,261 and 5,159,569.

SUMMARY OF INVENTION

The challenge of the formation temperature measurement is illustrated schematically in FIG. 1, diagrams 1A, 1B, and 1C, where three phases of temperature evolution around a wellbore are shown:

1. The formation cooling during drilling and mud circulation (diagram 1A).
2. The temperature build-up (during tripping, etc.) after mud circulation has been terminated (diagram 1B).
3. The "production" phase, when the temperature of produced fluid in the flowline of a formation testing tool, is measured, as will be described (diagram 1C).

Usually, due to obvious time constraints, the formation-cooling phase during drilling followed by the temperature build-up after stoppage of circulation is much longer than the measurement phase during "production" (i.e., fluid passing through the tool flow line). For this reason, the measured temperature range may be much smaller than the temperature contrast between the wellbore and the formation induced prior to tool deployment. This also means that there is a risk that the formation temperature could be underestimated if it is determined by measuring the temperature of the produced fluid, as proposed in the above-listed Published PCT International Patent Application WO 02/057595A1.

An approach hereof involves the modeling of thermal history by solving a forward problem and then processing temperature measurement data to capture the trend of temperature evolution that allows determination of initial formation temperature.

In accordance with an embodiment of the invention, a method is set forth for determining virgin formation temperature of earth formations surrounding a borehole that is drilled using drilling fluid, including the following steps: keeping track of the time duration of drilling fluid circulation at borehole depth regions of interest; keeping track of the time after cessation of drilling fluid circulation at said borehole depth regions of interest; at a particular borehole depth region of interest, causing flow of fluid from the formations into a device in the borehole, and measuring the temperature of the fluid as a function of time with respect to initiation of the fluid flow;modeling the thermal history of formations surrounding the particular borehole depth region, the modeling including a cooling phase during drilling fluid circulation, a temperature build-up phase after cessation of drilling fluid circulation, and a formation fluid flow phase after initiation of fluid flow; using the model and the temperature measurements, determining a trend of temperature evolution at the particular depth region; and determining the virgin formation temperature by extrapolation from said trend.

Further features and advantages of the invention will become more readily apparent from the following detailed description when taken in conjunction with the accompanying drawings.

BRIEF DESCRIPTION OF DRAWINGS

FIG. 1, which includes diagrams labeled

FIG. 6 is a flow diagram of the steps represented by the block 550 of FIG. 5.

FIG. 7 is another plot of measured temperature versus dimensionless temperature for representative data with a straight line fitted to the data, showing how $T_O$ and $T_W$ are determined.

DETAILED DESCRIPTION

Figure 1C:
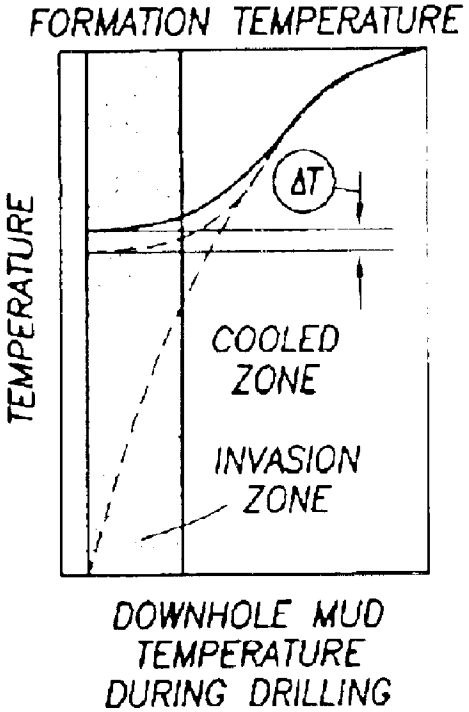
FIG. 1A, FIG. 1B and FIG. 1C, shows three phases of temperature evolution around a wellbore.
Figure 1B:
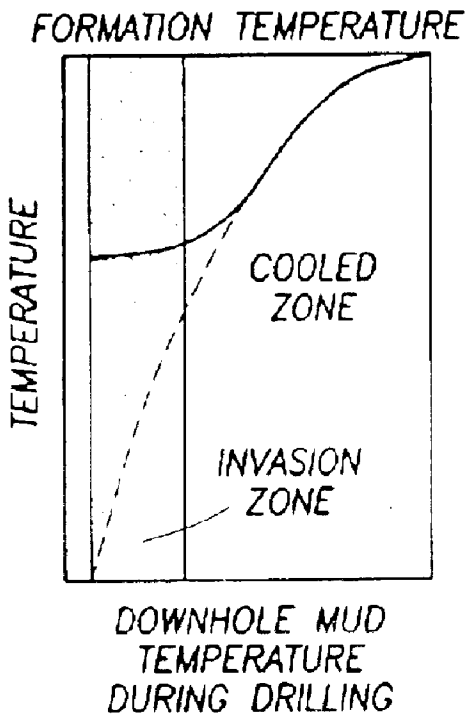
Figure 1A:
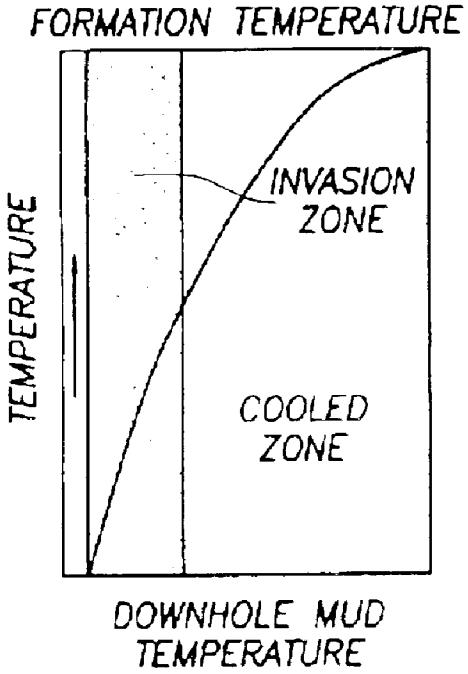

The present invention involves determination of the formation temperature, $T_O$, using the temperature data $$\{T_1(t_i), i=1,2, \ldots N\} \tag{1}$$

obtained during fluid production from the formation by measuring fluid temperature in a tool flowline. Here, $t_i$ are the discreet times of temperature acquisition.

The drilling and subsequent operation schedule prior to temperature data acquisition is known and therefore the entire thermal history can be represented as a sequence of three events with known durations: 1. The cooling of the formation during drilling, $0<t<t_D$, by circulating mud. 2. The temperature build-up around a wellbore after stoppage of mud circulation required for pulling out the drill string from the wellbore and lowering the wireline formation testing tool downhole. The duration of this phase, $t_O$, is usually substantially shorter than the drilling phase, i.e. $t_O,<t_D$.3. The "production" phase which, herein, is used for the temperature data acquisition by the formation testing tool. The duration of this phase, $t_P$, is usually substantially shorter than the two previous phases, i.e. $t_P<t_D+t_O$.

In the present embodiment, it is assumed that all physical parameters listed below, which characterize thermal and mechanical properties of the formation and the drilling mud, either are known or can be reasonably estimated:

Formation

Thermal conductivity=K

Specific heat of rock=$C_R$

Permeability=k

Porosity=

$\phi$

•

Rock density=$\rho_R$

Bulk modulus=B

Fluid viscosity=$\mu$

Fluid density=$\rho_F$

Specific heat of fluid=$C_F$

Mud

Density=$\rho_M$

Specific heat=$C_M$

Modeling assumptions for the present embodiment are listed below. It will be understood that some of these can be varied.

The thermal history covering the formation cooling phase is represented by a single unknown parameter, which is the average wellbore temperature, $T_W$, opposite the interval of "production" (testing). This parameter and the initial formation temperature, $T_O$, are the only unknowns that have to be determined from the temperature measurements data of (1).

The heat exchange between the fluid and the formation is instantaneous and therefore they always have the same temperatures. This assumption may not be valid in the wellbore neighborhood where flow velocities are high.

The viscosity contrast between mud filtrate and virgin formation fluid is neglected.

The Darcy law for a homogeneous fluid governs the flow in the formation. An extension of this assumption could be the inclusion of the inertial effects of fluid flow near a wellbore.

The convective heat transport in the formation induced by the mud filtrate invasion is neglected. This assumption may be inadequate in a case of poor mudcake quality and deep invasion.

The effect of fluid/rock compressibility on the heat transfer in the formation is neglected.

The thermal conductivity of formation, as well as the densities and heat capacities of fluid, rock and mud, are constant.

Geometry simplification: the 3D flow in the formation induced by the fluid production through the probe is replaced by the axi-symmetrical flow to a small wellbore interval of height equal to wellbore diameter. This assumption has previously been used interpreting formation testing measurements.

The heat transfer model is described by an equation of heat conduction during formation cooling while drilling and temperature build-up after stoppage of circulation and by the convection-conduction equation during "production". Both equations can be represented in a single form $$c\rho\frac{\partial T}{\partial t}+\mathrm{div}(q_r+q_\alpha)=0,\ q_r=K\nabla T,\ q_\sigma=\sigma_r\rho_r T\nabla \tag{2}$$

where T is the temperature, v is the fluid flow velocity in the formation, $q_T$ is the conductive heat flux, and $q_C$ is the convective heat flux. The formation specific heat, c, and its density, ρ, can be expressed through the rock and fluid properties $$c=\phi c_F+(1-100\ )c_R,\ \rho=\phi\rho_F+(1-\phi)\rho 6\mathrm{hd}\ \mathrm{R} \tag{3}$$

During cooling and build-up, the flow velocity is equal to zero and Eq. (2) become a classical heat conduction equation $$\frac{\partial T}{\partial t}=\alpha\nabla^2 T,\ \alpha=\frac{K}{c\rho} \tag{4}$$

where α is the thermal diffusivity and $$\Delta^{\alpha}\mathrm{T}$$

is the Laplace operator. The Darcy law and the continuity equation govern the fluid flow in the formation $$\nabla=\frac{u}{\mu}\nabla_P \tag{5}$$

$$\frac{\partial P}{\partial t}=\frac{B}{\phi\mu}div(k\nabla p) \tag{6}$$

where ρ is the pressure and k is the permeability tensor.

Figure 2:
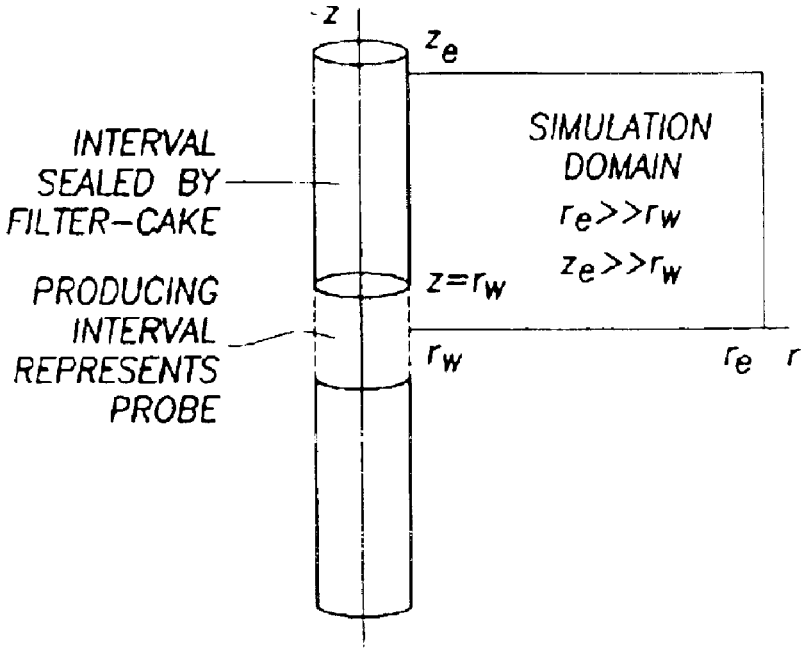
FIG. 2 is a diagram of the simulation domain, used in an embodiment of the invention.

The geometry and boundary conditions are treated as follows. The simulation domain is chosen as shown in FIG. 2 in the cylindrical coordinates (r,z) with the z-axis directed vertically along the wellbore. The probe is replaced by the small producing interval, $|z|\leqq r_W$. This makes the whole problem axi-symmetrical if the wellbore is vertical and the permeability anisotropy is characterized by the ratio $k_H/k_V$ only, where $k_H$ is the horizontal permeability and $k_H$ is the vertical permeability.

In this case, the middle cross-section of the producing interval, z=0, represents the plane of symmetry and the simulation domain is a rectangle adjacent to the borehole and an upper half of the producing interval. Its far field boundaries, $r=r_e$ and $z=z_e$, are assumed to be far enough from the producing interval in order to represent adequately the boundary conditions at infinity in numerical simulation:

Constant pressure at both far field boundaries;

The temperature is equal to the initial formation temperature, $T_O$, at $r=r_e$, $|z|<z_e$;

Zero heat flux through the boundary $z=z_e$, $r_W<r<r_e$.

The borehole wall outside of the producing interval is assumed to be sealed by the filter cake and is always maintained under zero-flux condition. It is assumed that the producing interval is also sealed during formation cooling and temperature build-up after stoppage of circulation. It is also assumed that, during production phase, the fluid flux is distributed uniformly over the surface of the producing interval. Since the fluid production rate, $q_O$, is known, the flow velocity through the producing interval is represented by its radial component $$\upsilon_r = \frac{q_0}{4\pi\tau_W^2},\ r = t_W,\ |z| < \tau_W \tag{7}$$

The boundary conditions for the temperature at the producing interval and the sealed wellbore will vary with time. They are given below for all three phases of thermal history.

Cooling phase ($0<t<t_D$);

$$T=T_w, T=r_w, |z|<z_e \tag{8}$$

Build-up phase ($t_D<t<t_1=t_+t_O$);

$$\int_{t_0}^{t} 2xr_W K \frac{\partial T}{\partial r}\bigg|_{rw_w} dt = xr_W^2 c_M \rho_M (T - T_W),\ r = r_W,\ |z| < z_e \tag{9}$$

Production phase ($t_1<t\ t<t_2==t_{1+}t_p$)

Producing interval($r=r_W$, $|z|<r_W$):

$$qr=0 \tag{10}$$

Sealed wellbore.($r=r_W$, $r_W<|z|<z_e$):

$$\int_{t_b}^{r} 2xr_W K \frac{\partial T}{\partial r}\bigg|_{rw_w} dt = \pi r_W^2 \rho_{Ni} \rho_{Ni} (T - T_W) \tag{11}$$

The boundary conditions (9) and (11) describe the heat exchange between the formation and the stagnant mud inside the wellbore, i.e. the mud heating during temperature build-up around the wellbore after stoppage of mud circulation.

The condition (10) at the producing interval represents the situation when the total heat flux from the boundary is equal to the convective flux. This is a conventional boundary condition at boundaries with non-zero fluid flux when the convection is a predominant mechanism of heat transport. This Is the case for the present problem.

The problem formulated in the present embodiment involves two unknown parameters: the initial formation temperature, $T_O$, and the average wellbore temperature during drilling, $T_W$, representing the cooling history. Since the problem is linear with respect to the temperature, T, both unknowns, $T_0$ and $T_W$, can be eliminated from the formulation using linear temperature transformation. This can be achieved by introducing the dimensionless temperature $$\Theta = \frac{T - T_W}{T_e - T_W} \tag{12}$$

It is also convenient to normalize other variables as follows $$X = \frac{t}{r_W},\ Z = \frac{z}{r_W},\ r = \frac{\alpha t}{r_W^2},\ P = \frac{P}{p_0},\ V = \frac{\nabla}{v_0} \tag{13}$$

where X and Z are the dimensionless coordinates, T is the dimensionless time, whereas P and V are the dimensionless pressure and velocity respectively. The pressure scale, $p_O$, will be specified subsequently.

The thermal diffusivity equation (4) describing formation cooling temperature build-up does not depend on the axial coordinate Z and therefore can be presented as $$\frac{\partial\Theta}{\partial r} = \frac{1}{X}\frac{\partial}{\partial X}\left(X\frac{\partial\Theta}{\partial X}\right) \tag{14}$$

It has to be solved with the initial condition f $$\Theta=1,\ \tau=0 \tag{15}$$

and the boundary condition at the wellbore for the cooling phase $$\Theta=0,\ X=1,\ 0<\tau<\tau_D \tag{16}$$

and for the build-up phase $$\frac{\partial\Theta}{\partial r} = \frac{2}{\beta_M}\frac{\partial\Theta}{\partial X},\ X = 1,\ \tau_D < \tau < \tau_1 \tag{17}$$

Here, three dimensionless parameters are involved $$\tau_D = \frac{\alpha t_D}{\tau_w^2},\ r_1 = \frac{\alpha t_1}{r_W^2},\ \beta_w = \frac{c_M, \rho_M}{c\rho} \tag{18}$$

The two times, $T_D$ and $T_1$, that represent the operation schedule and therefore can vary significantly, and the ratio of heat capacities of mud and rock is $\beta_M$, which may change only slightly in different testing environments (well locations, depths).

The dimensionless axi-symmetrical convection-conduction equation (2) is $$\frac{\partial\Theta}{\partial\tau} + \gamma\nabla_{xv}\cdot(\Theta V) = \nabla_{xv}^2\Theta,\ \gamma = \frac{\beta\gamma_W \upsilon_\alpha}{\alpha},\ \omega = \sqrt{\frac{k_W}{k_v}} \tag{19}$$

where, if the velocity field is stationary, $$\nabla_{xv}^2 T = \frac{1}{X}\frac{\partial}{\partial X}\left(X\frac{\partial\Theta}{\partial X}\right) + \frac{\partial^2\Theta}{\partial Z^4},\quad \nabla_{xv}\cdot(\Theta V) = -\frac{1}{X}\frac{\partial}{\partial X}\left(X\Theta\frac{\partial P}{\partial X}\right) - \frac{\partial}{\partial Z}\left(\frac{\Theta}{\omega^\beta}\frac{\partial P}{\partial Z}\right) \tag{20}$$

It involves, together with the permeability anisotropy ratio ω, an additional dimensionless parameter, Y, which is usually of the order of 10. This confirms the above conclusion about predominance of the convective heat transport over the conduction.

The boundary conditions for the dimensionless temperature during production phase($T>T_1$) are $$\frac{\partial\Theta}{\partial X} = 0,\ X = 1,\ 0 < Z < 1 \tag{21}$$

$$\frac{\partial\Theta}{\partial r} = \frac{2}{\beta_M}\frac{\partial\Theta}{\partial X},\ X = 1,\ 1 < Z < Z_e \tag{22}$$

$$\frac{\partial\Theta}{\partial Z} = 0,\ X = X_e,\ Z = Z_e \tag{23}$$

$$\Theta = 1,\ X = X_e,\ 0 < Z < Z_e \tag{24}$$

where $X_e=r_e/r_W$, $Z_e=Z_e/r_W$ are the dimensionless coordinates of the far field boundaries.

The determination of the velocity, V, which is involved in Eq. (19), requires solving the following boundary value problem for the dimensionless pressure $$\frac{1}{X}\frac{\partial}{\partial X}\left(X\frac{\partial P}{\partial X}\right)+\omega^{-0}\frac{\partial^2 P}{\partial Z^e}=0 \tag{25}$$

$$\frac{\partial P}{\partial X}=-1,\ X=1,\ 0<Z<1 \tag{26}$$

$$\frac{\partial P}{\partial X}=0,\ X=1,\ 1<Z<Z_e \tag{27}$$

$$P=P_e,\ 1<X<X_e,\ Z=Z_c;\ X=X_c,\ 1<Z<Z_e \tag{28}$$

where $P_e=p_e/p_0$ and the boundary condition (26) is obtained by choosing the characteristic pressure as $$P_0=\mu\gamma W^v{}_O/k_\gamma \tag{29}$$

It can be noted that the far field pressure $P_e$ does not affect the solution of convection-conduction equation and can be chosen arbitrary.

Thus, the dimensionless formulation of the forward problem involves five parameters only $$T_D, T_1, \gamma, \omega, \beta_M \tag{30}$$

The additional scales introduced for the purpose of numerical modeling only, which are associated with the far field boundaries, obviously, can be ignored. The first two parameters ($T_D$ and $T_1$) represent the operation schedule and the three others ($\gamma$, $\omega$ and $\beta_M$) the physical properties of the formation and the mud.

If this problem is solved, the temperature of produced fluid can be found by the temperature integration over the surface of the producing interval. This gives, for the dimensionless temperature, the expression $$\Theta_z(r)=\int_0^1 \Theta(1, Z, r)dZ \tag{31}$$

where $$\Theta_z(r)=\frac{T_z(t)-T_W}{T_0-T_W},\ T_z(t)=\frac{1}{r_W}\int_0^{r_W} T(r_W, \alpha, i)dz \tag{32}$$

An approach of this embodiment of the invention involves solving the forward problem formulated above and inverting the solution with respect to the unknown parameters, $T_O$ and $T_W$. The inversion technique of this embodiment does not involve any history matching procedures and is based on the linearity of the forward problem and the dimensional analysis only.

If all five parameters (30) are known or reasonably estimated, the inverse problem involves the determination of the two unknown temperatures, i.e. the initial formation temperature, $T_O$, and the average mud temperature inside the wellbore during drilling, $T_W$. These parameters have to be found by the inversion of the fluid temperature data, $\{T_L(t_1)\}$, obtained in a flowline during fluid production.

Figure 3:
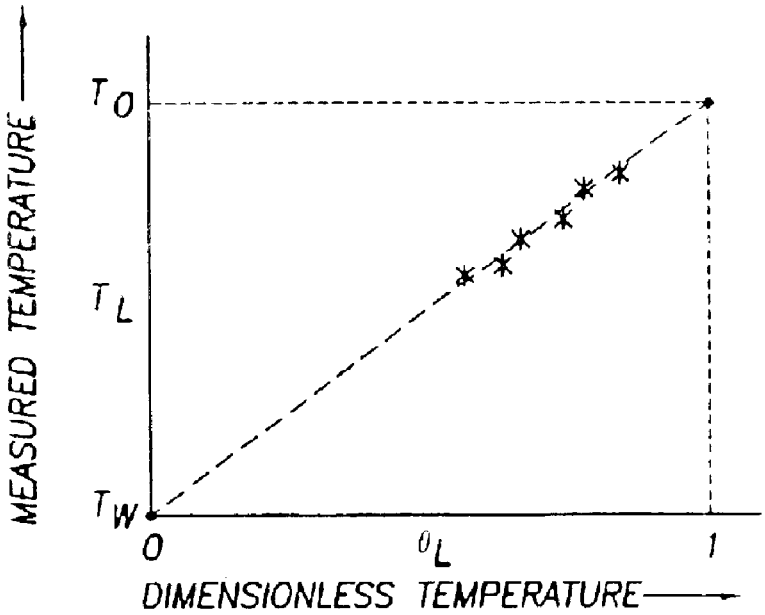
FIG. 3 shows a plot of measured temperature versus simulated dimensionless temperature, with a straight line fitted to the data.

The inversion procedure is based on the linear relationship $$T_1=T_W+\theta_L(T_O-T_W) \tag{33}$$

between the temperature measured in the flowline, $T_L$ (t), and the dimensionless temperature, $\theta_L$ (T), which has to be obtained by solving a forward problem. It involves the following steps:

1. The sequence of the dimensionless times $T_i=\alpha t_i/r_W^2$ corresponding to the temperature measurement data $\{T_L(t_i)\}$ is found.
2. Using solution of the forward problem $\theta_L(T)$, the dimensionless temperatures $\{\theta_L(T_i)\}$ are calculated.
3. Eliminating the times $t_i=r_W^2\ T_i/\alpha$ and $T_i$ between arrays $\{T_L(t_i)\}$ and $\{\theta_L(T_i)\}$, the measured temperature $T_L$ is plotted versus the simulated dimensionless temperature $\theta_L$ as shown in FIG. 3.
4. A straight line is fitted to the plotted data $T_L=F(\theta_L)$ as shown in FIG. 3, and its intercept points with axes corresponding to $\theta_L=1$ and $\theta_L=0$ are found. These interception points determine the initial formation temperature, $T_O=F(1)$, and the average wellbore temperature during drilling, $T_W=F(0)$.

One can expect that the measured temperatures $T_L(t_i)$ will fill only a small fraction of the entire temperature range $T_W<T<T<T_O$ and therefore the duration of temperature measurement phase as well as the production rate may affect the resolution of inversion. It will be evident that the wider the range of measured temperature, the more accurate the fitting and, therefore, the determination of the formation temperature, $T_O$, will be more accurate. Using more comprehensive models, that take into account the thermal capacity of the wireline tool and the heat exchange rate, may improve the amount and quality of data involved in the inversion procedure.

Figure 4:
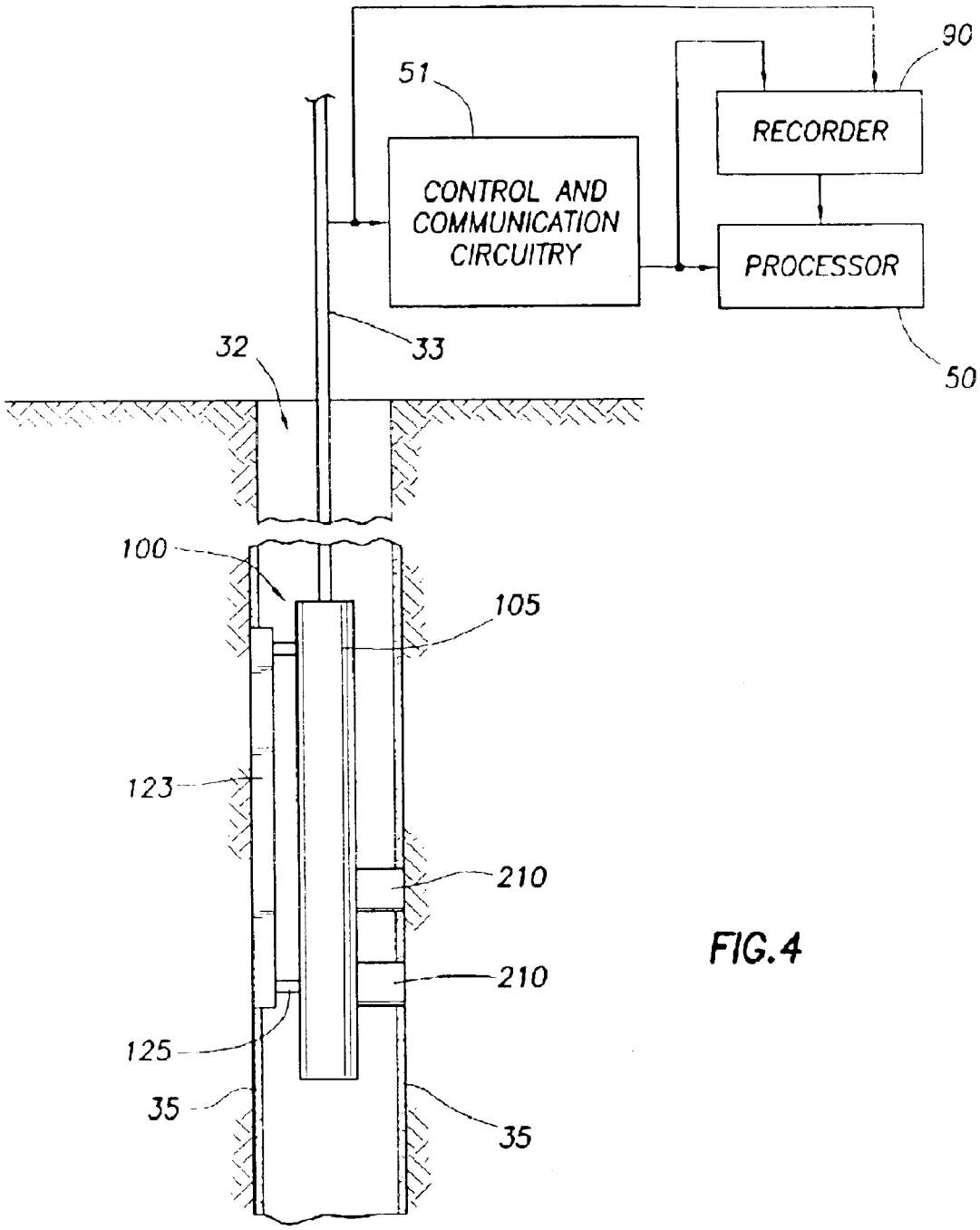
FIG. 4 is a diagram, partially in block form, of a formation testing wireline device which can be used in practicing an embodiment of the invention.

FIG. 4 shows the borehole 32 that has been drilled, in known manner, with drilling equipment, and using drilling fluid or mud that has resulted in a mudcake represented at 35. As previously noted, for each depth region of interest, the time of mud circulation and the time since cessation of mud circulation, is kept track of, in known manner, for example by using a clock or other timing means, processor, and/or recorder. FIG. 4 shows a representative embodiment of a formation tester apparatus or device 100 which can be used in practicing an embodiment of the invention. The apparatus 100 is suspended in the borehole 32 on an armored multiconductor cable 33, the length of which substantially determines the depth of the device 100. Known depth gauge apparatus (not shown) is provided to measure cable displacement over a sheave wheel (not shown) and thus the depth of logging device 100 in the borehole 32. Circuitry 51, shown at the surface although portions thereof may typically be downhole, represents control and communication circuitry for the investigating apparatus. Also shown at the surface are processor 50 and recorder 90. These may all generally be of known type, and include appropriate clock or other timing means.

The tool 100 has an elongated body 105 which encloses the downhole portion of the apparatus, controls, chambers, measurement means, etc. One or more arms 123 can be mounted on pistons 125 which extend, e.g. under control from the surface, to set the tool. The device includes one or more probe modules, each of which includes a probe assembly 210 which is movable with a probe actuator (not separately shown) and includes a probe (not separately shown) that is outwardly displaced into contact with the borehole wall, piercing the mudcake and communicating with the formations. The equipment and methods for taking pressure measurements and doing formation fluid sampling are well known in the art, and the logging device 100 is provided with these known capabilities. Reference can be made, for example, to U.S. Pat. Nos. 3,934,468 and 4,860,581, which describe early versions of devices of this general type.

Modern commercially available services utilizing, for example, a modular formation dynamics tester ("MDT"-trademark of Schlumberger), can provide a variety of measurements and samples, as the tool is modularized and can be configured in a number of ways. Examples of some of the modules employed in this type of tool, are as follows: An electric power module is generally provided. It does not have a flowline or hydraulic bus, and will typically be the first (top) module in the string. A hydraulic power module provides hydraulic power to all modules that may require same, and such power can be propagated via a hydraulic bus. Probe modules, which can be single or plural probes, includes pistons for causing engagement of probe(s) for fluid communication with the formations. Sample modules contain sample chambers for collecting samples of formation fluids, and can be directly connected with sampling points or connected via a flowline. A pumpout module can be used for purging unwanted fluids. An analyzer module uses optical analysis to identify certain characteristics of fluids. A temperature measurement capability is also provided. A packer module includes inflatable packer elements which can seal the borehole circumference over the length of the packer elements. Using the foregoing and other types of modules, the tool can be configured to perform various types of functions. The present invention has application to tool configurations which draw formation fluid into the tool, and return the fluid into borehole.

Figure 5B:
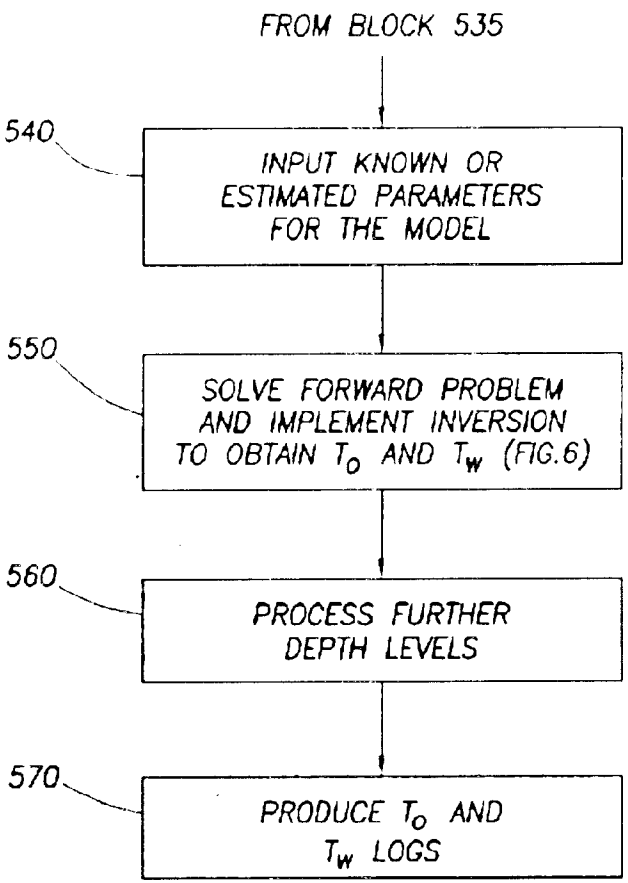
FIG. 5, which includes FIGS. 5A and 5B placed one below another, is a flow diagram setting forth a sequence of steps or routine in accordance with an embodiment of the invention.
Figure 5A:
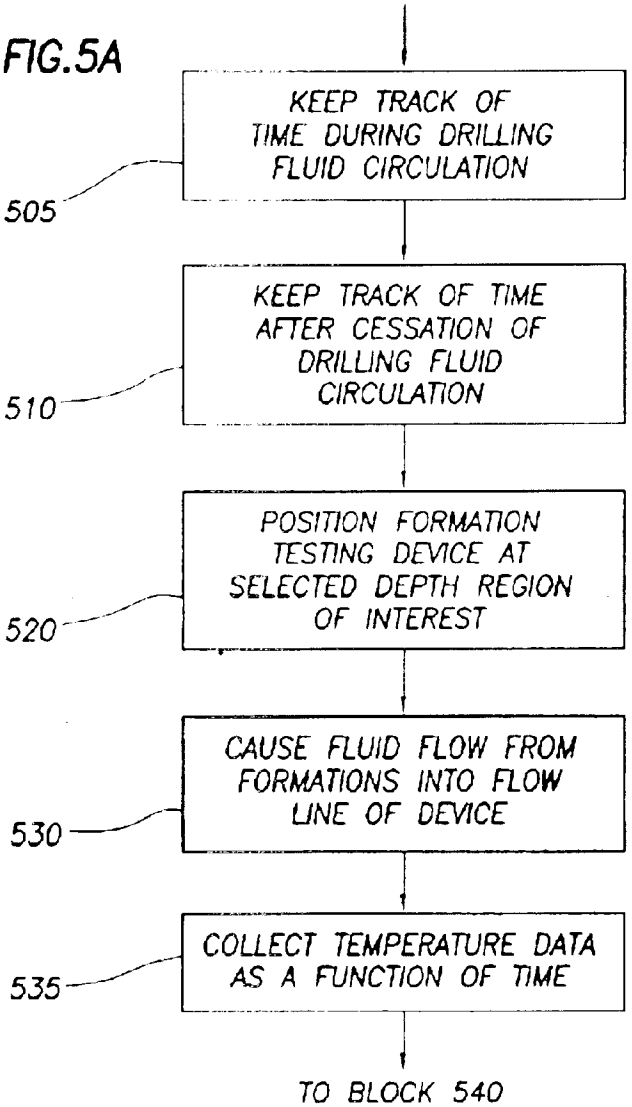

Referring to FIG. 5, there is shown a diagram of the steps of a process for determining virgin formation temperature at depth regions of interest. The steps, or at least some of them, can be implemented by one or more processors, at and/or away from the wellsite. The block 505 represents keeping track of the duration of drilling fluid circulation time, denoted as $t_D$ above. As previously indicated, this can be conventionally performed at the wellsite. Similarly, the block 510 represents keeping track of the time after cessation of drilling fluid circulation (the temperature build-up time, $t_O$, as above), which can also be conventionally performed at the wellsite. The block 520 represents positioning the formation testing device at a selected depth region of interest. Then, at the selected depth region, fluid is caused to flow (block 530) from the formations into the flowline of the formation testing device. Typically, and as is known in the art, substantial fluid will pass through the flow line before relatively uncontaminated fluid is in the line. As represented by the block 535, temperature data is collected as a function of time. This can be done, for example, continuously or periodically, and by analog or digital means. As noted above, it is known in the art that formation testing equipment can be equipped with temperature sensing capability. In the present embodiment, digital temperature measurements, as a function of time, are available for processing.

The block 540 represents the inputting of known or estimated parameters for the heat exchange model. In the present embodiment, these are as listed above, although it will be understood that variations on the model and the parameters can be made, consistent with the spirit and scope of the claimed invention. The described inversion procedure is then implemented (block 550) to obtain the trend of temperature evolution at the depth region being processed, and to determine virgin formation temperature by extrapolation from the trend.

Refer, momentarily to FIG. 6, which is a flow diagram of the steps represented by the block 550 of FIG. 5. The block 551 represents obtaining the dimensionless times $T_{Ti}$. This is done using the expression for T in equations (13). Then, as represented by the block 552, using solution to the forward problem $\theta_L$ (T), the dimensionless temperatures $\{\theta_L (T_i)\}$ are calculated. Then, measured temperature versus simulated dimensionless temperature $\theta_L$ is plotted (block 553), as in FIG. 3. Reference can also be made to the FIG. 7 diagram, which shows how the diagram will look for an actual case. Interpolation can then be utilized (block 554) to obtain virgin formation temperature $T_O$ and average wellbore temperature $T_W$. In the example of FIG. 7, these are $T_O$=177° F. and $T_W$=189.7 degrees. It will be understood that the plotting and interpolation can be performed graphically or can be done using software widely available for this purpose.

Referring again to FIG. 5, the block 560 represents processing further depth regions in similar manner, and the block 570 represents producing logs of virgin formation temperature $T_O$ and average borehole Temperature $T_W$ as a function of depth level, using the obtained temperature determinations.

The invention has been described with reference to a particular preferred embodiment, but variations within the spirit and scope of the invention will occur to those skilled in the art. For example, it will be understood that other devices can be used for implementing the obtaining and temperature measuring on the fluid from the formations.

What is claimed is:

1. A method for determining virgin formation temperature of earth formations surrounding a borehole that is drilled using drilling fluid, comprising the steps of:

keeping track of the time duration of drilling fluid circulation at borehole depth regions of interest;

keeping track of the time after cessation of drilling fluid circulation at said borehole depth regions of interest;

at a depth of interest, causing flow of fluid from the formations into a device in the borehole, and measuring the temperature of said fluid as a function of time with respect to initiation of said fluid flow;

modeling the thermal history of formations surrounding the depth of interest, said modeling including a cooling phase during drilling fluid circulation, a temperature build-up phase after cessation of drilling fluid circulation, and a formation fluid flow phase after initiation of fluid flow;

using said model and said temperature measurements for determining a trend of temperature evolution at said depth of interest; and determining the virgin formation temperature by extrapolation from said trend.

2. The method as defined by claim 1, wherein said step of causing flow of fluid from the formations into a device in the borehole and measuring the temperature of said fluid as a function of time comprises positioning a formation testing device at the depth region of interest, drawing fluid from the formations into said device, and measuring, in said device, the temperature of said fluid.

3. The method as defined by claim 2, further comprising repeating the steps of the method for determining virgin formation temperature determination for other depth regions of interest.

4. The method as defined by claim 3, further comprising producing a log of the determined virgin formation temperatures as a function of depth.

5. The method as defined by claim 1, wherein said step of modeling the thermal history of said formations comprises formulating model equations that include a function of the unknown virgin temperature, $T_o$, and a function of the unknown average borehole temperature during drilling fluid circulation $T_w$.

6. The method as defined by claim 5, fiber comprising repeating the steps of the method for determining $T_o$ and for determining $T_w$.

7. The method as defined by claim 6, further comprising producing logs of $T_o$ and $T_w$ as a function of depth.

8. The method as defied by claim 1, wherein said step of determining a trend of temperature evolution at a depth of interest includes performing an inversion to obtain a trend of measured temperature versus dimensionless temperature.

9. The method as defined by claim 1, wherein said model includes, during said formation fluid flow phase, a representation of heat conduction and heat convention during fluid flow.

10. The method as defined by claim 1, wherein said step of modeling the thermal history includes inputting to the model, the density and specific heat of the drilling fluid, and the following physical parameters of the formations: thermal conductivity, specific heat of rock, specific heat of fluid permeabiltty, porosity, rock density, fluid density, bulk modulus, and fluid viscosity.

11. The method as defined by claim 9, wherein said step of modeling the thermal history includes inputting to the model, the density and specific heat of the drilling fluid, and the following physical parameters of the formations: thermal conductivity, specific heat of rock, specific heat of fluid permeability, porosity, rock density, fluid density, bulk modulus, and fluid viscosity.

12. In a method for determining virgin formation temperature of earth formations surrounding a borehole that is drilled using drilling fluid, that includes the steps of: keeping track of the time duration of drilling fluid circulation at borehole depth regions of interest; keeping track of the time after cessation of drilling fluid circulation at said borehole depth regions of interest, and, at a depth of interest, causing flow of fluid from the formations into a device in the borehole, and measuring the temperature of said fluid as a function of time with respect to initiation of said fluid flow; the improvement comprising:

modeling the thermal history of formations surrounding the depth of interest, said modeling including a cooling phase during drilling fluid circulation, a temperature build-up phase after cessation of drilling fluid circulation, and a formation fluid flow phase after initiation of fluid flow;

using said model and said temperature measurements for determining a trend of temperature evolution at said depth of interest; and determining the virgin formation temperature by extrapolation from said trend.

13. The method as defined by claim 12, further comprising repeating the stops of the method for determining virgin formation temperature determination for other depth regions of interest.

14. The method as defined by claim 13, further comprising producing a log of the determined virgin formation temperatures as a function of depth.

15. The method as defined by claim 12, wherein said step of modeling the thermal history of said formations comprises formulating model equations that include a function of the unknown virgin temperature, $T_o$, and a function of the unknown average borehole temperature during drilling fluid circulation, $T_w$.

16. The method as defined by claim 15, further comprising repeating the steps of the method for determining $T_o$ and for determining $T_w$.

17. The method as defined by claim 16, further comprising producing logs of $T_o$ and $T_w$ as a function of depth.

18. The method as defined by claim 12, wherein said step of determining a trend of temperature evolution at a depth of interest includes performing an inversion to obtain a trend of measured temperature versus dimensionless temperature.

19. The method as defined by claim 12, wherein said model includes, during said formation fluid flow phase, a representation of heat conduction and heat convention during fluid flow.

20. The method as defined by claim 12, wherein said step of modeling the thermal history includes inputting to the model, the density and specific heat of the drilling fluid, ant the following physical parameters of the formations; thermal conductivity, specific heat of rock, specific heat of fluid permeability, porosity, rock density, fluid density, bulk modulus, and fluid viscosity.

* * * * *